US006089822A

United States Patent [19]

Fukuno

[11] Patent Number: 6,089,822

[45] Date of Patent: Jul. 18, 2000

[54] GAS TURBINE STATIONARY BLADE

[75] Inventor: Hiroki Fukuno, Takasago, Japan

[73] Assignee: Mitsubishi Heavy Industries, Ltd., Tokyo, Japan

[21] Appl. No.: 09/179,816

[22] Filed: Oct. 28, 1998

[30] Foreign Application Priority Data

Oct. 28, 1997 [JP] Japan ..... 9-295408

[51] Int. Cl.[7] ..... F01D 5/14

[52] U.S. Cl. ..... 415/115; 415/116; 415/176; 416/97 R

[58] Field of Search ..... 415/115, 116, 415/176, 177, 178; 416/96 R, 96 A, 97 R

[56] References Cited

U.S. PATENT DOCUMENTS

| | | | |
|---|---|---|---|
| 5,320,483 | 6/1994 | Cunha et al. | 415/114 |
| 5,609,466 | 3/1997 | North et al. . | |
| 5,634,766 | 6/1997 | Cunha et al. . | |

FOREIGN PATENT DOCUMENTS

| | | |
|---|---|---|
| 5-163959 | 6/1993 | Japan . |
| 2093923 | 9/1982 | United Kingdom . |

*Primary Examiner*—Edward K. Look
*Assistant Examiner*—Ninh Nguyen
*Attorney, Agent, or Firm*—Wenderoth, Lind & Ponack, L.L.P.

[57] ABSTRACT

A gas turbine second stage stationary blade has cooling air passages of an inner shroud provided with enhanced cooling efficiency. In inner shroud 126, there are provided a leading edge passage 42 and trailing edge passage 44, both extending from blade portion and mutually separated by a rib 40, and impingement plates 83, 84 having a multiplicity of small holes 101. An opening portion 68 between the blade portion and the inner shroud 126 is closed by a bottom plate 150 and, together with a recess portion 100 at a bottom portion of the leading edge passage 42, connects to a passage 188 of a leading edge portion 41 via a passage 90'. Air from the trailing edge passage 44 flows into cavity 45 to be injected through the small holes 101 of the impingement plates 83, 84 for cooling of the central portion of the inner shroud 126 and is then discharged as air 60 through passages 92 of the trailing edge portion 43. The entire amount of air from the leading edge passage 42 enters the passage 188 is then enhanced in heat transfer effect by turbulators 200, further flows separately into passages 93, 94 of side edge portions for cooling therearound, and is then discharged as air 61. The air amount in the leading edge portion 41 and the side edge portions is increased and the cooling effect is enhanced.

4 Claims, 9 Drawing Sheets

GAS TURBINE STATIONARY BLADE

BACKGROUND OF THE INVENTION

1. Field of the Invention

The present invention relates to a gas turbine stationary blade, and more specifically to a gas turbine stationary blade having a cooling structure for applying air cooling to a second stage stationary blade with a high cooling efficiency.

2. Description of the Prior Art

In FIG. 1, a cross sectional view of a typical structure of gas turbine is shown and an outline thereof will be described first. In FIG. 1, numeral 1 designates a compressor portion, numeral 2 designates a combustor portion and numeral 3 designates a turbine portion. Numeral 4 designates a rotor, which extends in a turbine axial direction from the compressor portion 1 to the turbine portion 3 . Numeral 6 designates an inner housing and numerals 7, 8 designate cylinders of compressor portion 1, which surround an outer circumference of a compressor. Numeral 9 designates a cylindrical shell forming a chamber, numeral 10 designates an outer shell of the turbine portion 3, numeral 11 designates an inner shell of the turbine portion 3 numeral 12 designates a stationary blade of the compressor, and a plurality of the stationary blades being disposed along a compressor circumferential direction with equal spacing between each of the blades and in multi-stages along a compressor axial direction, and numeral 13 designates a moving blade of the compressor, a plurality of the moving blades being fixed around the rotor 4 and disposed alternately with the stationary blades 12 along the compressor axial direction.

Numeral 14 designates a chamber surrounded by the cylindrical shell 9 and numeral 15 designates a combustor, disposed in the chamber 14, into which fuel 35 is injected from a fuel nozzle 34 for combustion. Numeral 16 designates a duct for leading a high temperature combustion gas 30 generated in the combustor 15 into the turbine portion 3. Numeral 17 designates a second stage stationary blade of the gas turbine, which is the object of the present invention. In the case shown in FIG. 1, the gas turbine is constructed of four stage stationary blades and four stage moving blades disposed alternately therewith, and the high temperature combustion gas 30 passes through the blades and is discharged as an expanded gas 3. Numeral 21 designates a manifold of the compressor portion 1 and numeral 22 designates a manifold of the turbine portion 3. Cooling air is supplied from the manifold 21 of the compressor portion 1 to the manifold 22 of the turbine portion via a pipe 32 and an air piping 19.

In the gas turbine constructed as mentioned above, the fuel 35 is injected into the combustor 15 from the fuel nozzle 34 to be burnt to generate the high temperature combustion gas 30 and then flows into the turbine portion 3 to pass through a passage where the stationary blades and the moving blades are disposed alternately and to expand to rotate the moving blades and the rotor 4 and is discharged as the expanded gas 31.

On the other hand, while a portion of the cooling air is supplied from the compressor portion into the moving blades of the gas turbine for cooling thereof via rotor discs, a portion of the cooling air is also supplied from the manifold 21 of the compressor portion 1 into the manifold 22 of the turbine portion 3 for cooling of the second stage stationary blade 17 as well as to be used as seal air via pipe 32 and the air piping 19.

Next, the second stage stationary blade 17 will be described in detail. FIG. 6 is a cross sectional view of the second stage stationary blade 17 of the prior art gas turbine, the stationary blade being cut along a turbine axial direction at approximately a central portion of its inner shroud and seen from an inner side thereof, that is, on a rotor 4 side. FIG. 7 is a cross sectional view taken on line D—D of FIG. 6, FIG. 8 is a cross sectional view taken on line E—E of FIG. 6, FIG. 9 is a cross sectional view taken on line F—F of FIG. 6, FIG. 10 is a cross sectional view taken on line G—G of FIG. 6, FIG. 11 is a cross sectional view taken on line H—H of FIG. 6 and FIG. 12 is a cross sectional view taken on line J—J of FIG. 6.

In FIG. 6, numeral 26 designates an inner shroud and provided therein are a rib 40, a leading edge passage 42 and a trailing edge passage 44 mutually separated by the rib 40, and a projection portion 95 provided therearound. Numerals 96, 97 designate rails of both side edge portions of the inner shroud 26 and numerals 93, 94 designate passages of cooling air provided in the rails 96, 97, respectively. A passage 88 is provided in a leading edge portion 41 of the inner shroud 26 and a multiplicity of passages 92 are provided in a trailing edge portion 43 of the inner shroud 26. There are provided a multiplicity of needle-like fins in the passage 88, so that convection is accelerated and heat transfer efficiency is enhanced. Numeral 100 designates a recess portion formed by the projection portion 95 and numerals 83, 84 designate impingement plates, each having a multiplicity of small holes 101 provided therein as passages of air. Numerals 81, 82 designate a front flange and a rear flange, respectively, and there are provided passages 90, 91 in the front flange 81. Cooling air 57 which has entered the recess portion 100 passes through the passage 90 in the front flange 81 and the passage 88 in the leading edge portion 41 and then through the passage 91 in the front flange 81 and enters a chamber formed by the impingement plate 83. Also, a portion 58 of the cooling air which has entered the passage 88 passes through the passages 93, 94 in the rails 96, 97 of the side edge portions for cooling therearound and is discharged outside as a cooling air 61. The cooling air which has flowed through the small holes 101 of the impingement plates 83, 84 and the cooling air which has flown through the passage 91 gather together in the chamber to further flow through the multiplicity of passages 92 of the trailing edge portion 43 and to be discharged outside as a cooling air 60.

In FIG. 7, being a cross sectional view taken on line D—D of FIG. 6, the passage 88 is formed in the leading edge portion 41 of the inner shroud 26 and the multiplicity of needle-like fins 89 are provided therein. In a space between the front flange 81 and the rear flange 82 are provided the recess portion 100 in front of the projection portion 95 and a recess portion 99 to the rear of the projection portion 95. The impingement plate 84 is provided so as to form chamber 78 on an outer side of the impingement plate 84. In the front flange 81, there is provided on the passage 90 which connects to the passage 88. The portion 57 of the cooling air, flowing through the passages 90 and 88, and another portion 59 of the cooling air, passing through the small holes 101 of the impingement plate 84, gather together in the chamber 78 to further flow through the multiplicity of passages 92 of the trailing edge portion 43 and is then discharged as the cooling air 60.

In FIG. 8, being a cross sectional view taken on line E—E of FIG. 6, the second stage stationary blade 17 has the inner shroud 26 and the outer shroud 27 and a blade portion 25 is formed therebetween. The leading edge passage 42 in front of the rib 40 and the trailing edge passage 44 in the rear are formed between a leading edge portion 28 and a trailing edge portion 29 of the blade portion 25, and cylindrical members 46, 47 are inserted into these passages 42,44, respectively. There are provided a multiplicity of cooling air holes 70, 71 in side walls of the cylindrical members 46, 47, respectively, and also cooling air holes 72, 73 in bottom walls of the cylindrical members 46, 47, respectively. Further, there are provided a multiplicity of pins 62 in the trailing edge portion 29.

In the leading edge portion 41 of the inner shroud 26, the passage 88 and the needle-like fins 89 in the passage 88 are provided, and in the trailing edge portion 43 of the inner shroud 26, the passages 92 are provided so as to connect to a cavity 45 which is formed by the front and rear flanges 81, 82 and a seal support portion 66. A chamber 77 is formed by the impingement plate 84 in the cavity 45. On the inner side of the cavity 45, the seal support portion 66 supports a seal 33, by which a seal mechanism between the inner shroud 26 and rotor side arm portions 48 is constructed.

Cooling air 19' from the air piping 19 flows into the cylindrical members 46, 47 to be injected through the cooling air holes 70, 71 to impinge on walls of the leading edge passage 42 and the trailing edge passage 44 and to flow toward the inner side thereof as well as to be injected through the cooling air holes 72, 73 of the bottom walls of the cylindrical members 46, 47 to flow into opening portions 68, 69. Then the cooling air, as shown by numerals 75, 76 flows into the cavity 45. The cooling air then flows into a space between the inner shroud 26 and a front stage moving blade thereof and a space between the inner shroud 26 and a rear stage moving blade thereof via the seal 33 to thereby maintain the spaces in a higher pressure than in a passage of the high temperature combustion gas 30 to prevent the high temperature combustion gas 30 from coming into the spaces.

In FIG. 9, being a cross sectional view taken on line F—F of FIG. 6, a recess portion 98 and the chamber 77 are formed by the impingement plate 83 between the front flange 81 and the rear flange 82, and the passage 91 provided in the front flange 81 connects to the passage 88 and the passages 92 provided in the trailing edge portion 43 connect to the chamber 77. Cooling air 59 in the cavity 45 is injected into the chamber 77 through the small holes 101 of the impingement plate 83 for cooling therearound, as shown by arrows of the air 59. On the other hand, cooling air which has flowed through the passage 88 enters the passage 91 of the front flange 81 to join with the cooling air 59 in the chamber 77 so both are then discharged as the cooling air 60 through the passages 92 of the trailing edge portion 43.

In FIG. 10, being a cross sectional view taken on line G—G of FIG. 6, the recess portions 98, 99 are provided around the blade portion 25 and the passages 93, 94 are provided in the rails 96, 97, respectively. Also, the chambers 77, 78 are formed by the impingement plates 83, 84, respectively. Cooling air 75 flows into the cavity 45 from the leading edge passage 42 and flows therefrom into the chambers 77, 78 through the small holes 101 of the impingement plates 83, 84.

In FIG. 11, being a cross sectional view taken on line H—H of FIG. 6, the passages 90, 91 of the front flange 81 and the passages 93, 94 of the side edge portions are provided in both of the side edge portions of the inner shroud 26 and the passages 90, 91 connect to the passage 88 of the leading edge portion 41.

In FIG. 12, being a cross sectional view taken on line J—J of FIG. 6, the passage 94 of the rail 97 is provided extending through the trailing edge portion 43 so that the cooling air 61 is discharged therefrom and the impingement plate 83 is provided between the front flange 81 and the rear flange 82.

In the second stage stationary blade of a gas turbine described as above, the cooling air 57 from the recess portion 100 flows into the passage 88 of the leading edge portion 41 through the passage 90 of the front flange 81. There are provided the multiplicity of needle-like fins 89 in the passage 88, and thereby the cooling effect of the cooling air 57 is enhanced so that portions therearound are cooled efficiently. Then, the cooling air 57 bends approximately orthogonally at the passage 91 and flows into the chamber 77 formed by the impingement plate 83 to join with the cooling air flowing thereinto through the small holes 101 of the impingement plate 83 and flows together through the trailing edge portion 43 for cooling thereof and is discharged through the passages 92. Also, the cooling air which has been injected through the small holes 101 of the impingement plate 84 to enter the chamber 78 is likewise discharged through the passages 92.

Further, the portion 58 of the air which has entered the passage 88 passes through the passages 93, 94 in the rails 96, 97, respectively, of the side edge portions for cooling therearound and are discharged as the cooling air 61 from the trailing edge portion 43. Thus, the cooling air 75, 76 in the cavity 45 is portioned to be made effective use of, respectively flowing through the passage 88, in which heat transfer is enhanced by the needle-like fins 89, the passages 93, 94 in the rails 96, 97 and the multiplicity of passages 92 in the trailing edge portion 43, and thereby the entire cooling of the inner shroud 26 is aimed to be performed efficiently.

That is, according to the air cooled system of the second stage stationary blade of a gas turbine in the prior art as described above, in order to ensure the entire cooling effect of the inner shroud 26, the cooling air passes through the passage 88 and the needle-like fins 89 provided therein for enhancement of the cooling effect to further flow portionally into the chamber 77 formed by the impingement plate 83 through the passage 91 of the front flange 81, and also the cooling air is injected into the chambers 77, 78 through the small holes 101 of the impingement plates 83 , 84 for cooling of the central portion, and then both of the cooling air flows join together to flow through the multiplicity of passages 92 of the trailing edge portion 43 for cooling therearound. Further, the cooling air from the passage 88 of the leading edge portion 41 portionally flows through the passages 93, 94 of the rails 96, 97 of the side edge portions for cooling therearound.

According to the cooling structure mentioned above, however, while the entire inner shroud is cooled efficiently, the cooling air which has entered the passage 88 portionally flows out of the passage 91 for cooling of the central portion, hence in the leading edge portion 41 and the side edge portions which are especially exposed to the high temperature combustion gas, there occurs a shortage of the cooling air flowing in the passages 93, 94 of the side edge portions, resulting in insufficiency of cooling in the side edge portions.

Also, the cooling air entering the passage 88 of the leading edge portion 41 is a part of the cooling air entering the cavity 45 and comes from the recess portion 100 through the passage 90, and in order to further enhance the cooling effect of the leading edge portion 41, it is expected that the amount of the cooling air flowing therein and the flow velocity thereof are increased so as to enhance the cooling effect further.

SUMMARY OF THE INVENTION

In view of the foregoing problem in the prior art, it is an object of the present invention to provide a gas turbine stationary blade in which the entire cooling effect on inner shroud is further enhanced by a construction made such that the amount of cooling air entering a leading edge portion and the flow velocity thereof are increased, with the cooling effect thereof being further enhanced by agitation of the cooling air, and also the cooling air flowing in both side edge portions is increased.

In order to attain the object, the present invention provides the following mentioned in (1) to (3):

(1) A gas turbine stationary blade is constructed such that air from a compressor is led into an outer shroud to be further led into a leading edge side passage and a trailing edge side passage, both provided in the stationary blade, as cooling air of the stationary blade. The air is then partly led into a cavity formed in an inner shroud to be portionally led from the cavity into spaces formed between said stationary blade and front and rear moving blades adjacent thereto as a seal air as well as to be portionally led from the cavity into said inner shroud to flow through a central portion and a trailing edge portion of said inner shroud to be then discharged. A bottom plate closes a passage connecting the leading edge side passage to the cavity. A passage causes the entire amount of cooling air from the leading edge side passage to flow into a passage of the leading edge portion along the bottom plate. The cooling air flowing into the passage of the leading edge portion is caused to flow through both side edge portions and trailing edge portion to then be discharged outside.

(2) The gas turbine stationary blade as mentioned in (1) above can be provided with an adjusting plate for adjusting a flow passage cross sectional area in the passage of the leading edge portion.

(3) The gas turbine stationary blade as mentioned in (1) can be provided with a plurality of turbulators in the passage of the leading edge portion.

In the gas turbine stationary blade mentioned in (1) above, the cooling air which has flowed through the leading edge side passage for cooling the blade interior enters in its entire amount into the passage of the leading edge portion of the inner shroud for cooling of the leading edge portion and then is separated to flow into the passages of the side edge portions. The cooling air which has flowed through the passages of the side edge portions for cooling thereof enters the trailing edge portion for cooling thereof and is then discharged to the outside.

Thus, the entire amount of the cooling air which has flowed through the leading edge side passage for cooling of the blade interior enters the passage of the leading edge portion, so that the leading edge portion which is exposed to a high temperature combustion gas and is in a severe temperature condition, is cooled efficiently. The cooling air in the passage of the leading edge portion is then separated to flow through the respective side edge portions, whereby the side edge portions which are also exposed to the high temperature combustion gas, are cooled efficiently. Then, the cooling air is discharged out of the trailing edge portion.

Also, the cooling air from the trailing edge side passage enters the central portion of the inner shroud to spread therearound for cooling the central portion and then is discharged outside through the trailing edge portion. In the prior art case, the construction is such that the cooling air that enters the leading edge portion flows into a cavity to then be portionally used as a seal air and in the leading edge portion to be used as a cooling air thereof. But in the present invention, the entire amount of the cooling air from the leading edge side passage flows directly into the leading edge portion, hence air of high pressure can be supplied as it is, with an increased amount of air, as compared with the prior art case.

The cooling air which has flowed into the leading edge portion in the prior art case further flows portionally into the central portion of the inner shroud, but in the invention mentioned in (1) above, the passage connecting from the leading edge portion to the central portion is eliminated and the entire amount of the air in the passage of the leading edge portion flows separately into the side edge portions, hence the leading edge portion and the side edge portions, both being under severe temperature condition, are cooled efficiently as compared with the prior art case.

In the invention of (2) above, the flow passage cross sectional area of the leading edge portion is made appropriately narrower by the adjusting plate, hence the flow velocity of the cooling air therein is increased. Also, in the invention of (3) above, the turbulators are provided, hence the cooling effect of the leading edge portion is increased greatly by the agitating action of the turbulators as compared with the prior art case.

DESCRIPTION OF THE PREFERRED EMBODIMENTS

Figure 1:
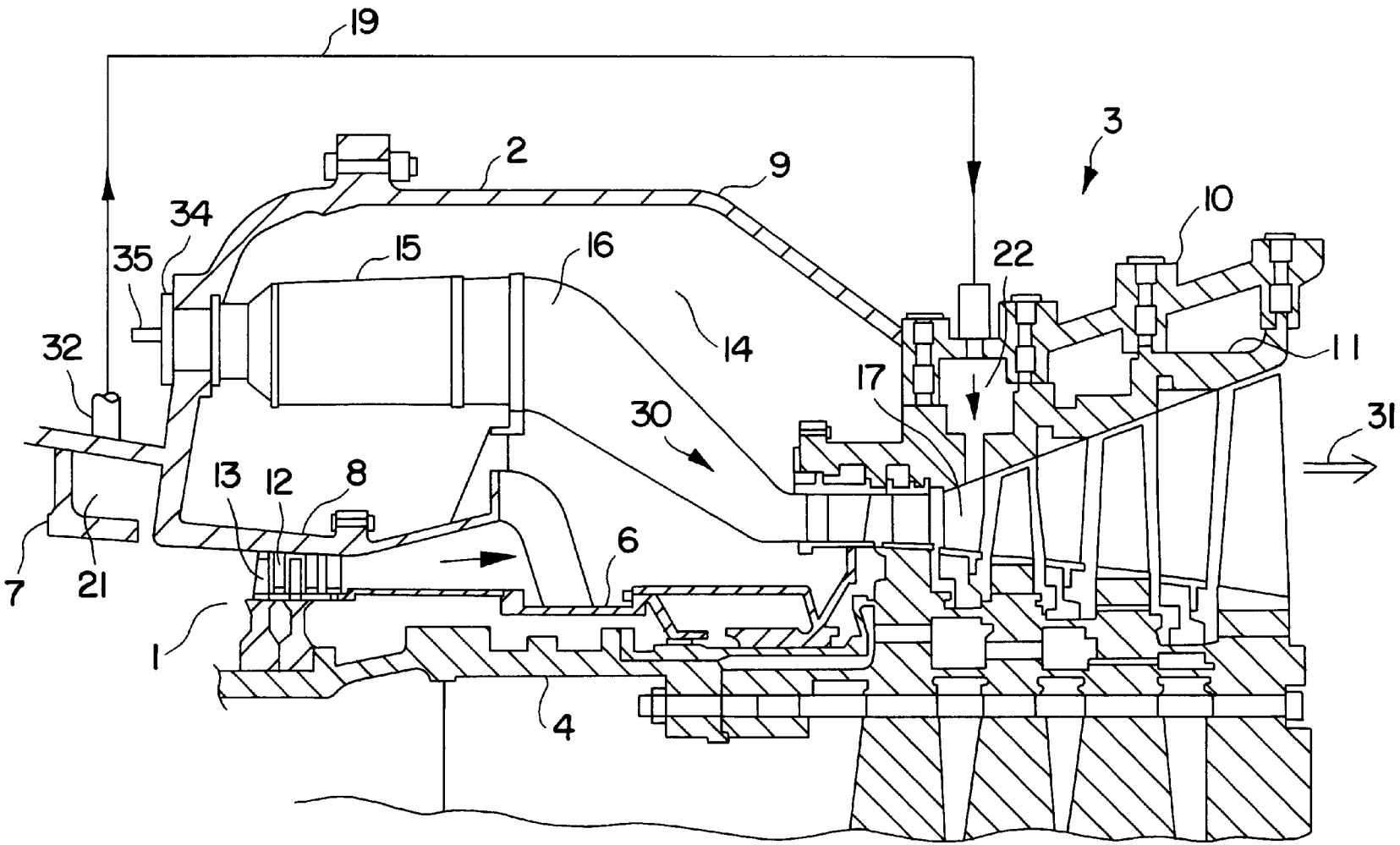
FIG. 1 is a cross sectional view of a gas turbine which includes a stationary blade of an object of the present invention.

Herebelow, description will be made on embodiments according to the present invention with reference to the figures. The present invention relates to a gas turbine stationary blade, and more specifically to a cooling structure of an inner shroud of a second stage stationary blade of a gas turbine. FIG. 1 is an entire cross sectional view of a gas turbine and a second stage stationary blade 17 shown there is the object of the present invention. The structure of other portions than the second stage stationary blade 17 of the present invention is the same as that described in the description of the prior art with repeated description thereof being omitted here. Featured portions of the present invention will be described with reference to FIGS. 2 to 5.

Figure 2:
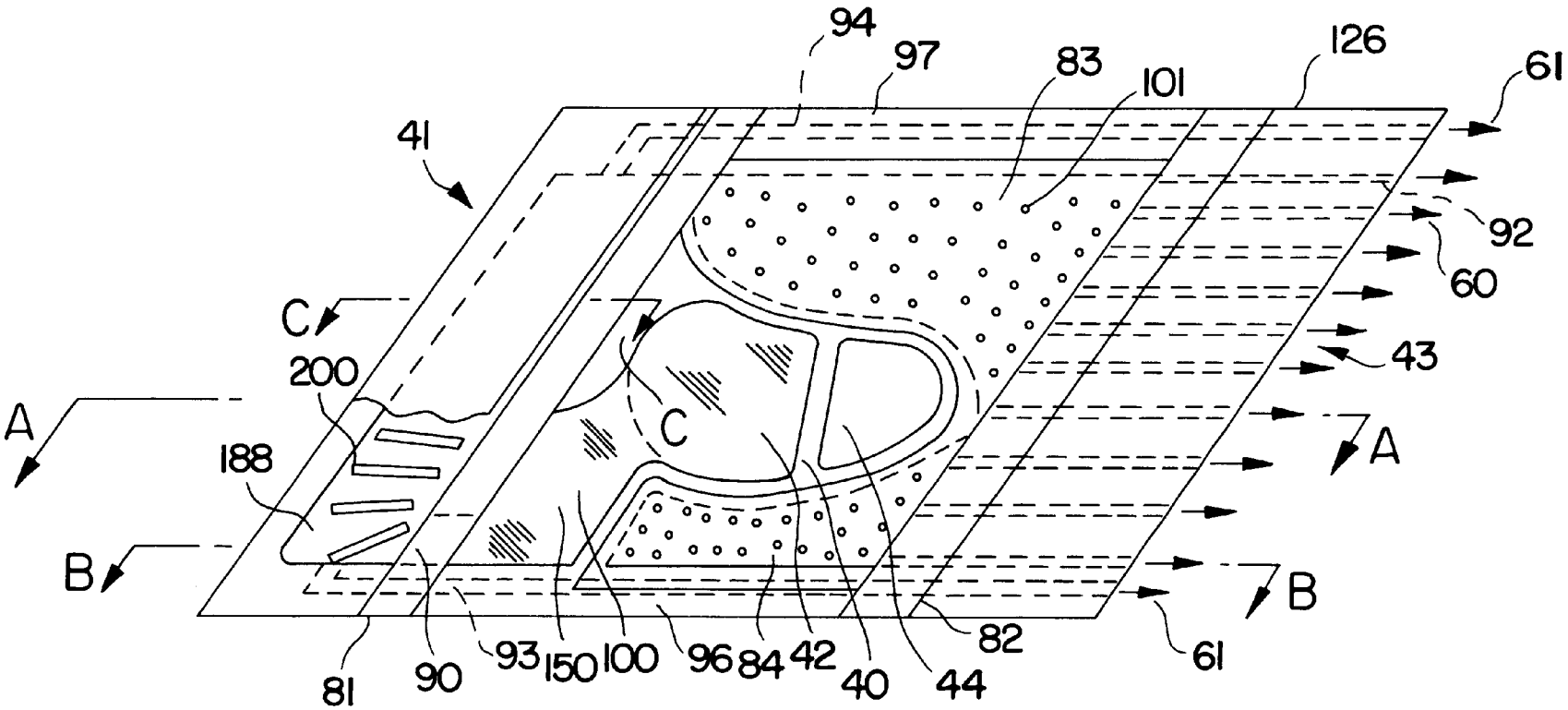
FIG. 2 is a cross sectional view of a gas turbine stationary blade of an embodiment according to the present invention, the gas turbine stationary blade being cut at its inner shroud portion along a turbine axial direction and seen from inner side thereof.
Figure 6:
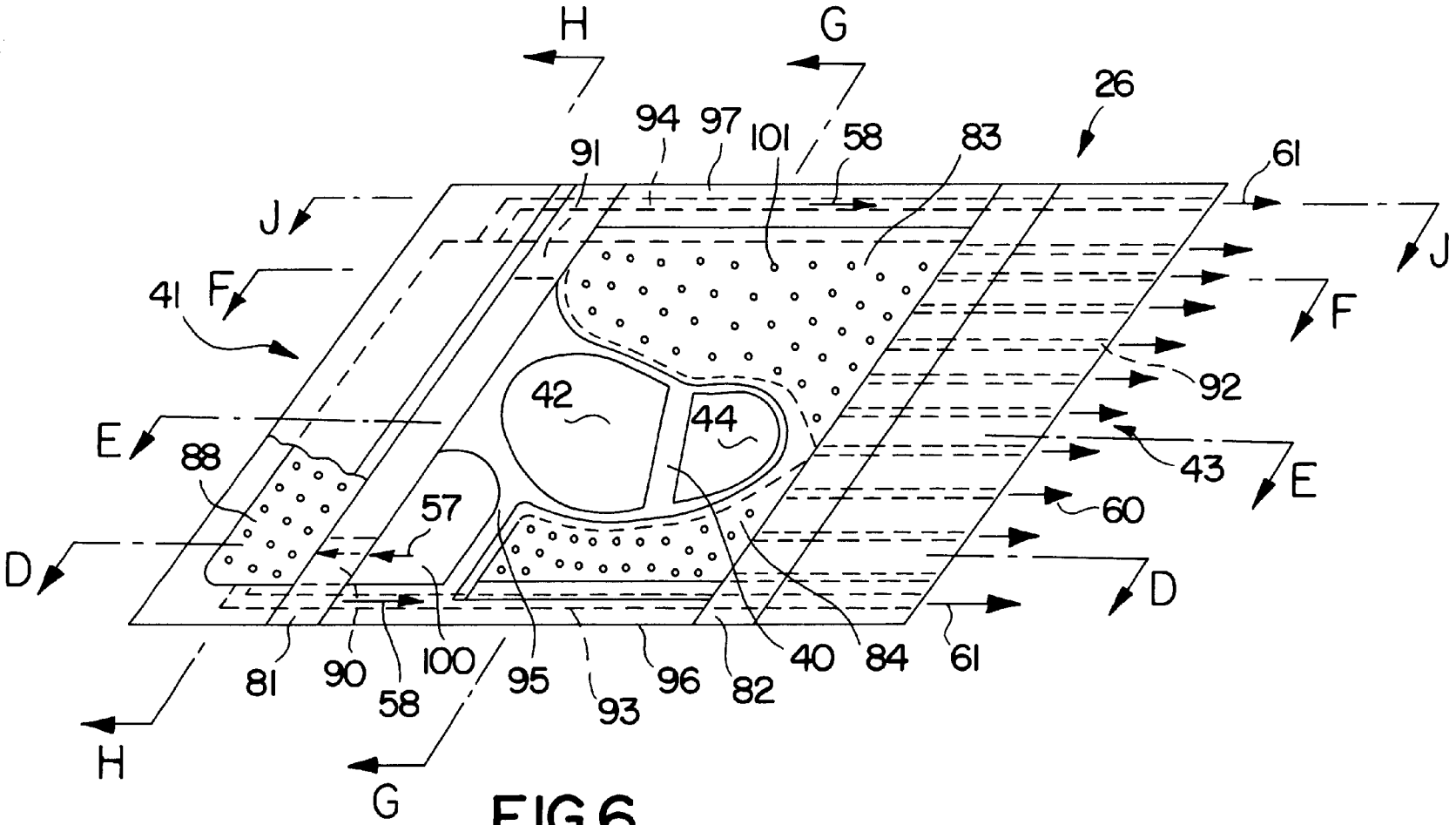
FIG.6 PRIOR ART
FIG. 6 is a cross sectional view of a prior art gas turbine stationary blade, the gas turbine stationary blade being cut at its inner shroud portion along a turbine axial direction and seen from inner side thereof.
Figure 7:
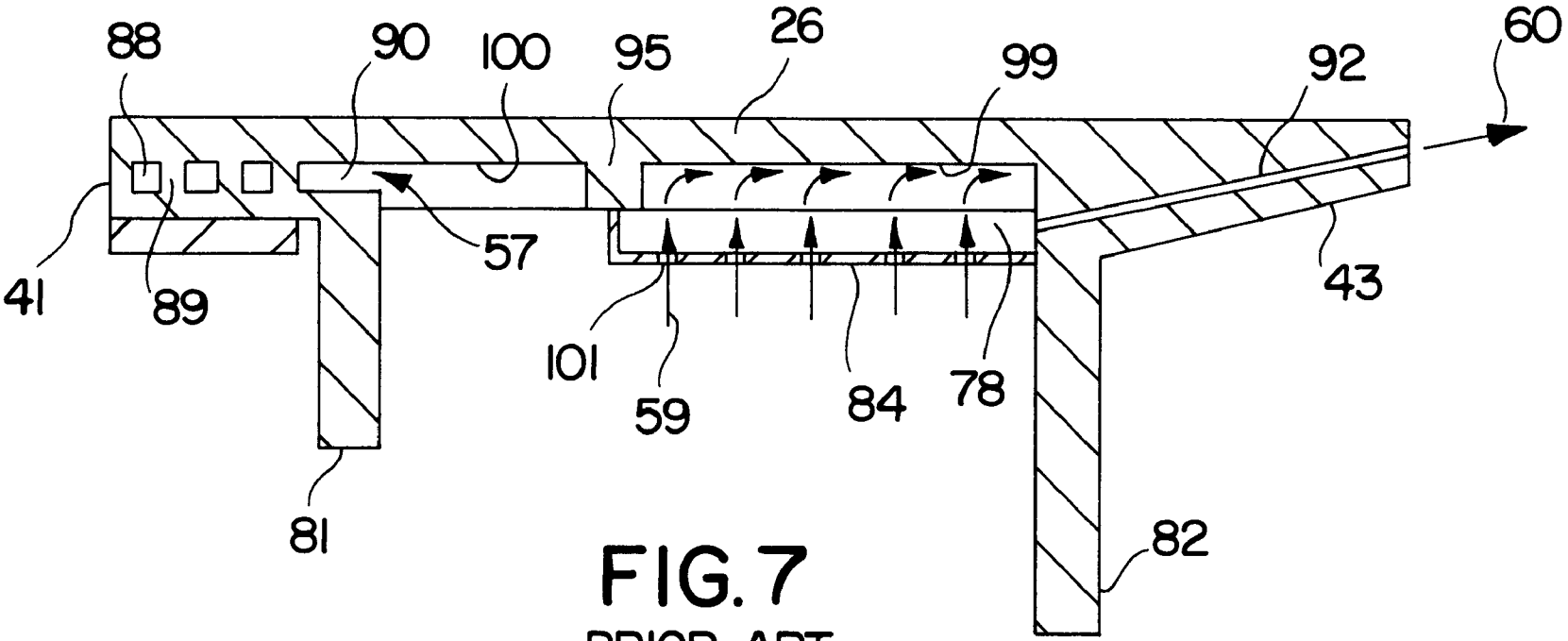
FIG. 7 PRIOR ART
FIG. 7 is a cross sectional view taken on line DD of FIG. 6.
Figure 8:
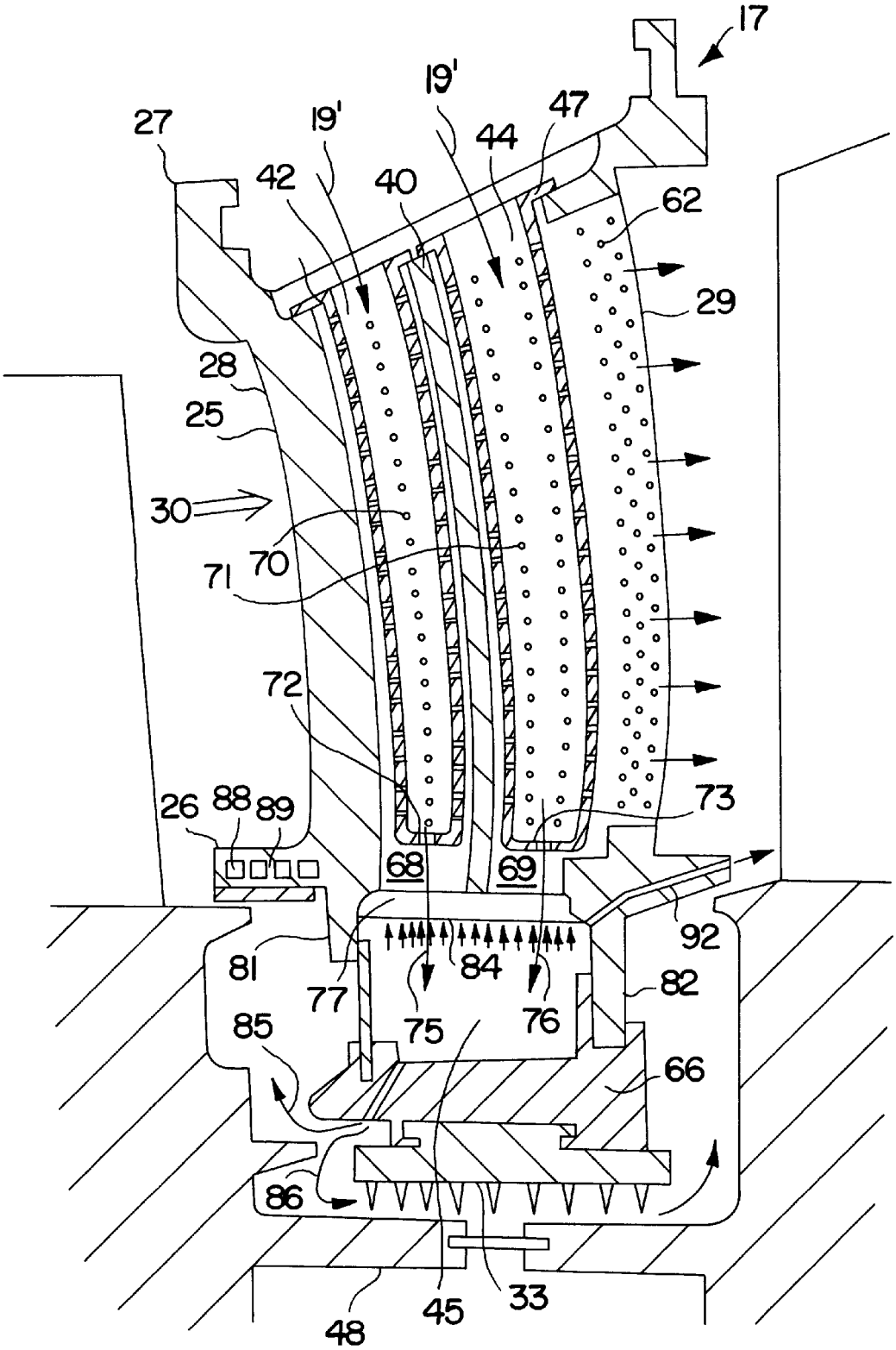
FIG. 8 PRIOR ART
FIG. 8 is a cross sectional view taken on line EE of FIG. 6.
Figure 9:
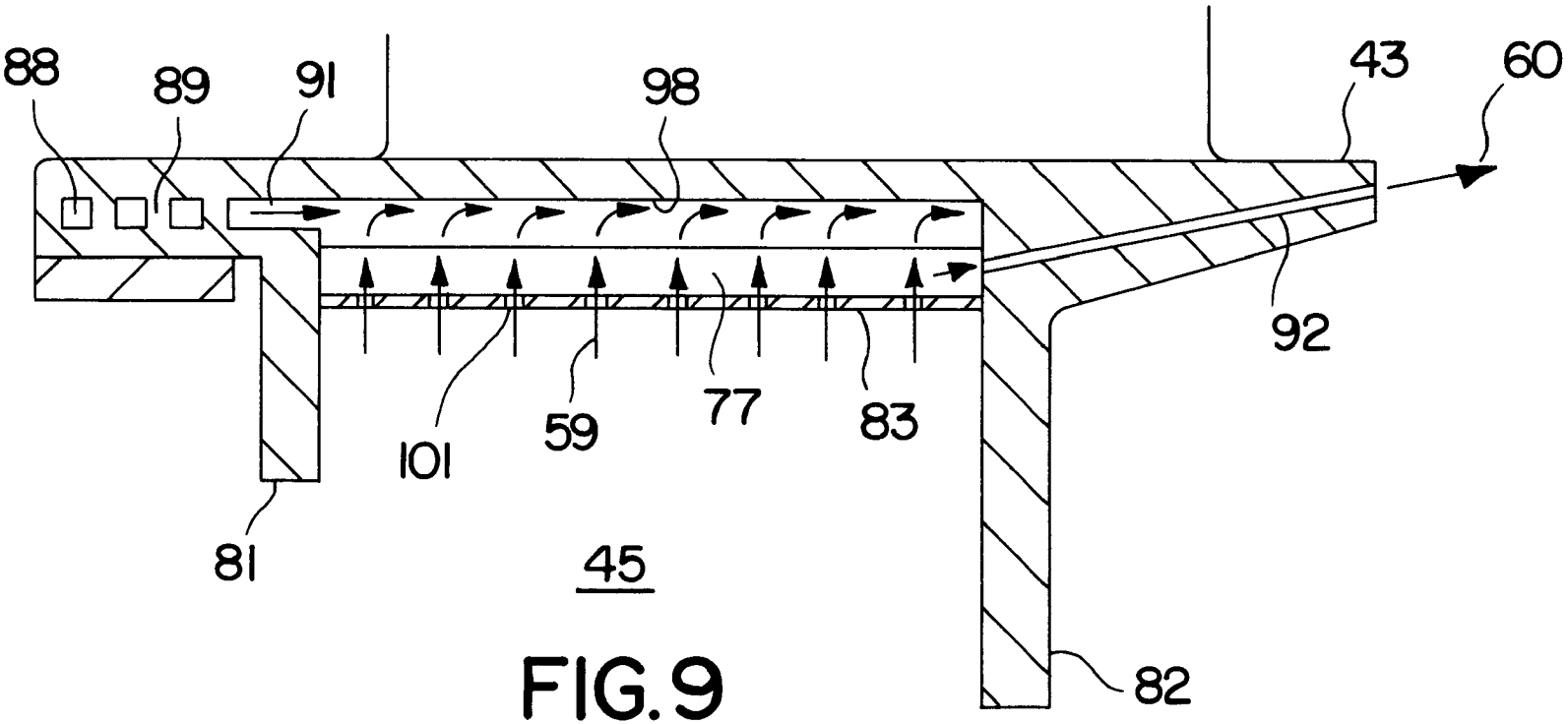
FIG. 9 PRIOR ART
FIG. 9 is a cross sectional view taken on line FF of FIG. 6.
Figure 10:
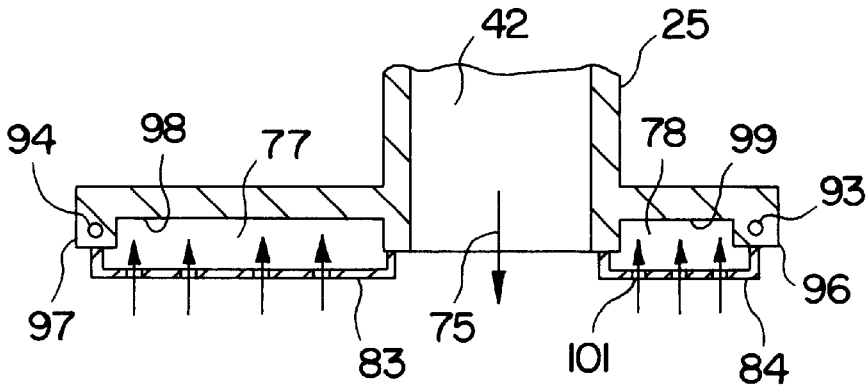
FIG. 10 PRIOR ART
FIG. 10 is a cross sectional view taken on line G—G of FIG. 6.
Figure 11:
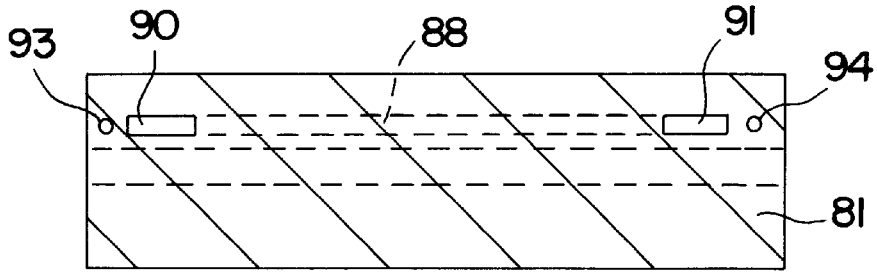
FIG. 11 PRIOR ART
FIG. 11 is a cross sectional view taken on line H—H of FIG. 6.
Figure 12:
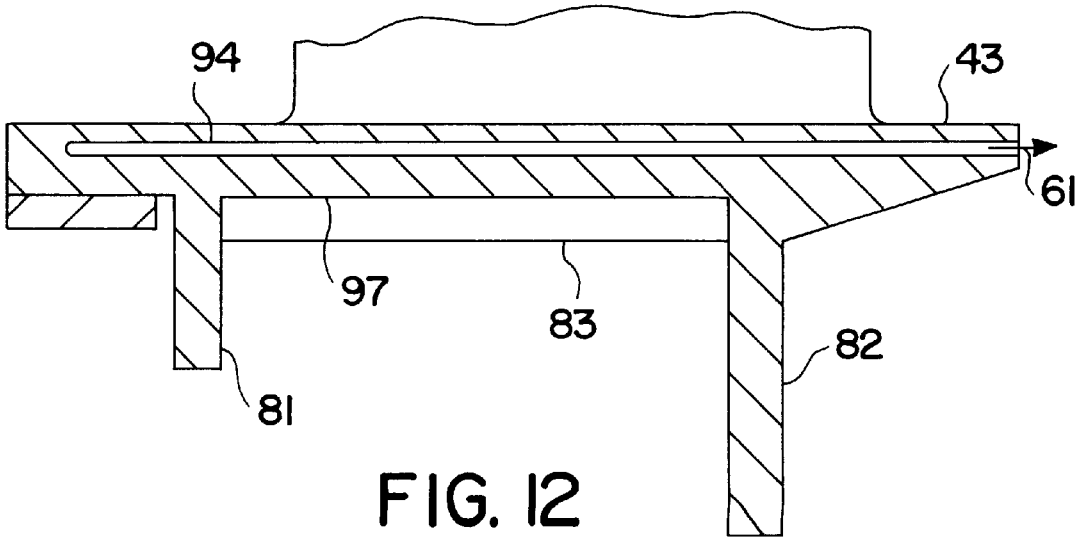
FIG. 12 PRIOR ART
FIG. 12 is a cross sectional view taken on line J—J of FIG. 6.

FIG. 2 is a cross sectional view of the second stage stationary blade 17 which is cut along a turbine axial direction at approximately a central portion of its inner shroud 126 and seen from an inner side thereof, that is, on a rotor side. In FIG. 6, provided between a front flange 81 and a rear flange 82 of the inner shroud 126 are a rib 40 at a central portion, and a leading edge passage 42 and a trailing edge passage 44 mutually separated by the rib 40, and impingement plates 83, 84 therearound having a multiplicity of small holes 101. There are also provided rails 96, 97 on both side edge portions of the inner shroud 126 and passages 93, 94 in the rails 96, 97, respectively, and a multiplicity of passages 92 in a trailing edge portion 43. Structures of these component parts are the same as those of the prior art shown in FIG. 6.

In a leading edge portion 41, there is provided a passage 188, which connects to a passage 90, provided in the front flange 81 so as to lead cooling air therein. The passage 188 has a width of flow passage which is narrower than the prior art, as described later, and has a plurality of turbulators 200 provided therein for further enhancing an agitating effect of the internal air flow than the prior art needle-like fins.

Further, the prior art passage 91 (see FIG. 6) for outflow of the air is eliminated so that the entire amount of the cooling air which has entered the passage 188 flows out into the passages 93, 94 provided in the rails 96, 97 of the side end portions, with the result that a cooling effect of the side edge portions is further enhanced.

Furthermore, a bottom plate 150, as described later is provided at a bottom portion of the leading edge passage 42, so that the entire amount of the cooling air flowing from the leading edge passage 42 flows into the passage 188 through the passage 90'. Thus, as compared with the prior art structure in which the air comes from the cavity, cooling air of higher pressure can be supplied directly from the leading edge passage 42 and both the flow amount and the flow velocity of the air can be increased.

In the inner shroud 126 mentioned above, the entire amount of the cooling air supplied from the leading edge passage 42 enters the passage 188 through the passage 90, to be agitated by the turbulators 200 for cooling of the leading edge portion 41 with an enhanced heat transfer. It is separated to flow into the respective passages 93, 94 in the rails 96, 97 of the side edge portions for cooling the side edge portions to then be discharged out of the passages 92 of the trailing edge portion 43 as air 61 after being used for cooling.

On the other hand, as described later, cooling air supplied from the trailing edge passage 44 flows into a cavity 45 to then be injected through the small holes 101 of the impingement plates 83, 84 for cooling of a central portion of the inner shroud 126 with an impingement effect and is discharged out of the multiplicity of passages 92 of the trailing edge portion 43 as air 60 after being used for cooling.

Figure 3:
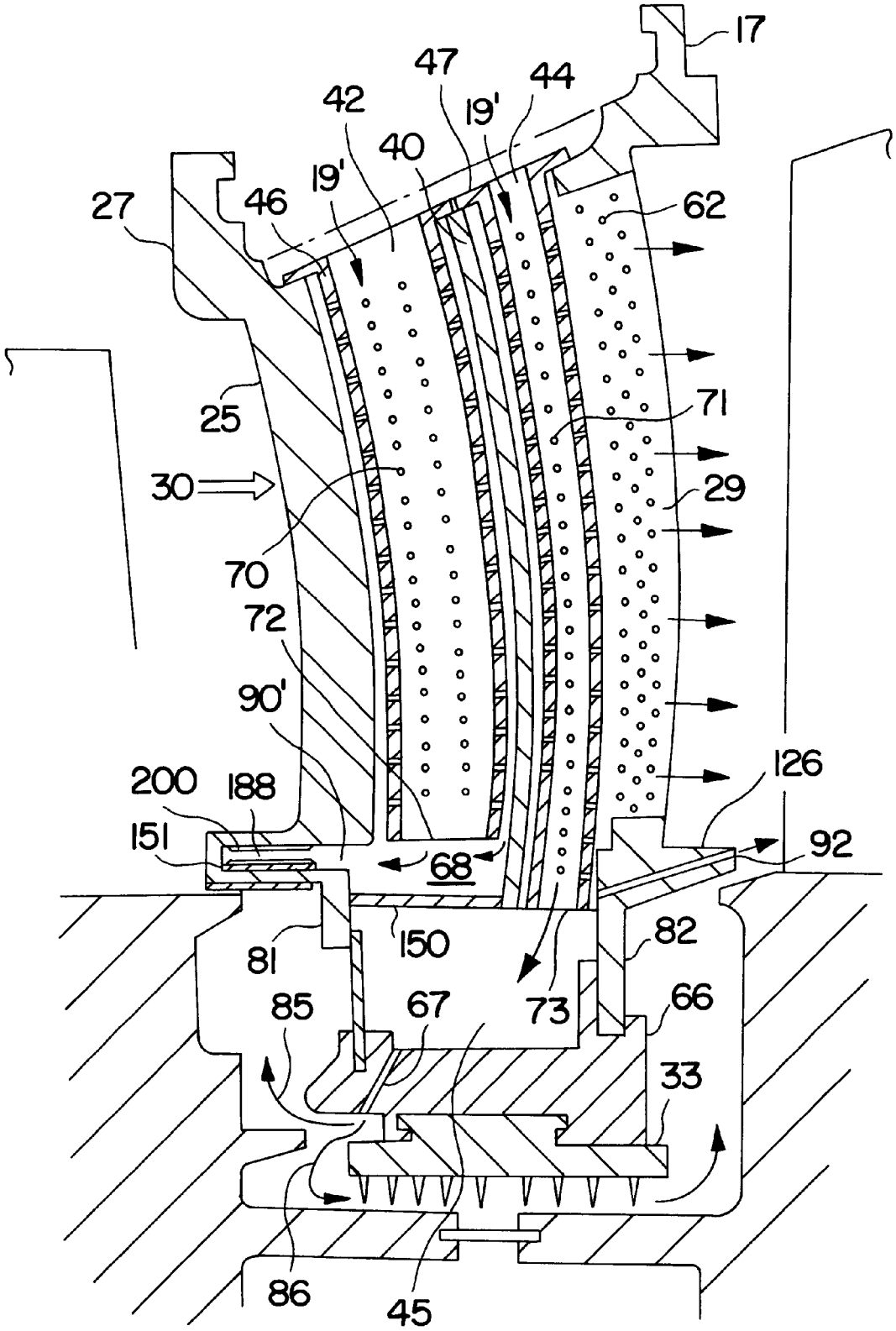
FIG. 3 is a cross sectional view taken on line AA of FIG. 2.

FIG. 3, being a cross sectional view taken on line A—A of FIG. 2, shows interiors of the stationary blade and the inner shroud. In FIG. 3, the second stage stationary blade 17 consists of a blade portion 25, an outer shroud 27 and the inner shroud 126. In the blade portion 25, there are provided the rib 40 and the leading edge passage 42 and the trailing edge passage 44 mutually separated by the rib 40. A cylindrical member 46 is provided in the leading edge passage 42 and a cylindrical member 47 is provided in the trailing edge passage 44, and a multiplicity of cooling holes 70, 71 are provided in side walls of the cylindrical members 46, 47, respectively. Also, cooling air holes 72, 73 are provided in bottom walls of the cylindrical members 46, 47, respectively.

In the inner shroud 126, the front flange 81 and the rear flange 82 are provided so as to form therebetween the cavity 45. In the cavity 45, the impingement plate 83 is provided so as to form a chamber 78 and also a bottom plate 150 is provided so as to close a bottom portion of the leading edge passage 42 to thereby form an opening portion 68. In the trailing edge portion 43, there are provided the multiplicity of passages 92 connecting to the cavity 45.

The opening portion 68 connects to the passage 90' of the front flange 81 so that entire amount of the cooling air from the leading edge passage 42 may flow into the passage 188. In the passage 188, an adjusting plate 151 is provided so as to make narrower a cross sectional area of flow passage of the passage 188 and to increase the flow velocity of the cooling air. Also, in the passage 188, there are provided the turbulators 200 as mentioned above.

Cooling air 19' enters the cylindrical members 46, 47 and flows through the cooling air holes 70, 71 to impinge on wall surfaces of the leading edge and trailing edge passages 42, 44 for cooling of the wall surfaces with an increased heat transfer effect. The cooling air which has cooled the wall surface of the leading edge passage 42 flows to the opening portion 68 to join with the cooling air which has flown through the cooling air hole 72 of the bottom portion of the cylindrical member 46. The cooling air which has entered the cylindrical member 47 flows portionally into the cavity 45 through the cooling air hole 73 and portionally flows through the cooling air holes 71 for cooling of the wall surface of the trailing edge passage 44. The cooling air which has cooled the wall surface of the trailing edge passage 44 flows portionally through a trailing edge portion 29 of the blade portion 25 to be discharged outside therefrom and portionally flows into the cavity 45 to join with the cooling air which has entered there through the cooling air hole 73, and then enters the chamber 78 or chambers (not shown) through the impingement plates 83, 84 for cooling of a central portion of the inner shroud 126. It is then discharged outside through the multiplicity of passages 92 of the trailing edge portion 43.

Also, as described in the prior art example, the cooling air in the cavity 45 flows out portionally through a hole 67 of a seal supporting portion 66 as shown by air 85 and 86. The air 85 flows into a space between the inner shroud 126 and a front stage moving blade thereof, whereby the space is maintained at a higher pressure than in a passage through which an outside high temperature combustion gas 30 passes so that the high temperature gas is prevented from coming thereinto. Also, the air 86 flows through a seal 33 to enter a space between the inner shroud 126 and a rear stage moving blade thereof, whereby this space is likewise maintained at a higher pressure and the high temperature gas is prevented from coming thereinto.

As described above, the cooling air which has been supplied through the leading edge passage 42 for cooling of the blade portion 25 enters the opening portion 68, and the entire amount of this air flows into the passage 188 through the passage 90, because of the bottom plate 150. In the passage 188, the cross sectional area thereof is adjusted by the adjusting plate 151 so as to become narrower and to increase the flow velocity of the air therein. Further, the air flow is agitated by the turbulators 200 and the cooling effect is thereby increased. Hence, as mentioned with respect to FIG. 2, both the leading edge portion 41 and the trailing edge portion 43 are cooled efficiently.

Figure 4:
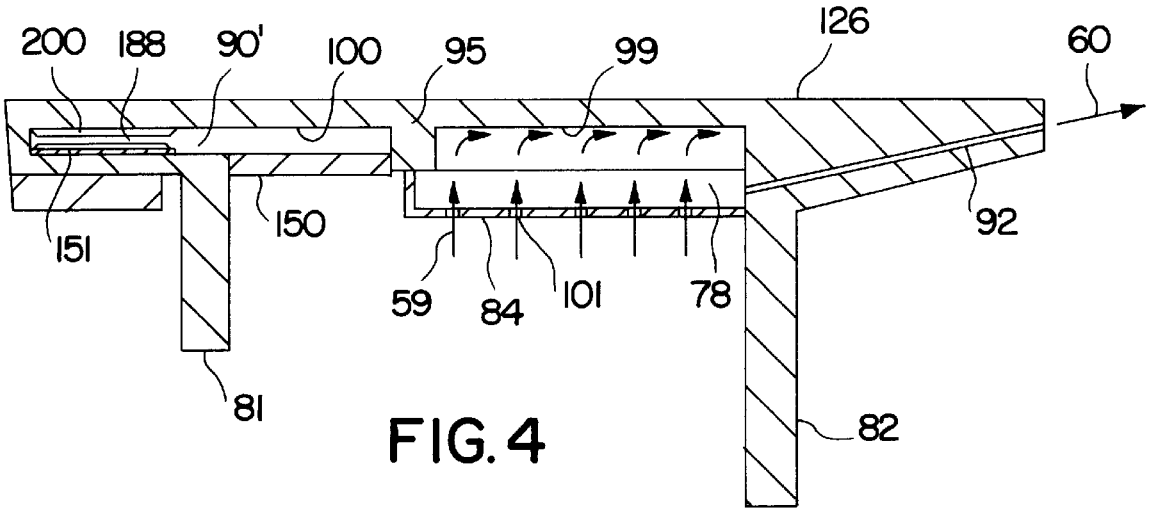
FIG. 4 is a cross sectional view taken on line BB of FIG. 2.

In FIG. 4, being a cross sectional view taken on line B—B of FIG. 2, between the front flange 81 and the rear flange 82 of the inner shroud 126, there are provided the impingement plate 84 having the multiplicity of small holes 101 and the bottom plate 150 for closing the bottom portion of the leading edge passage 42. In the leading edge portion 41, the passage 90' provided in the front flange 81 and a recess portion 100 connect to each other, and the entire amount of the cooling air from the leading edge passage 42 flows into the passage 188 of the leading edge portion 41 through the passage 90'. In the passage 188, the adjusting plate 151 and the turbulators 200 are provided, as mentioned before. Also, the cooling air from the trailing edge passage 44 is injected through the small holes 101 of the impingement plate 84 into the chamber 78 formed by the impingement plate 84 and a recess portion 99, thus all these portions are cooled with enhanced cooling effect.

Figure 5:
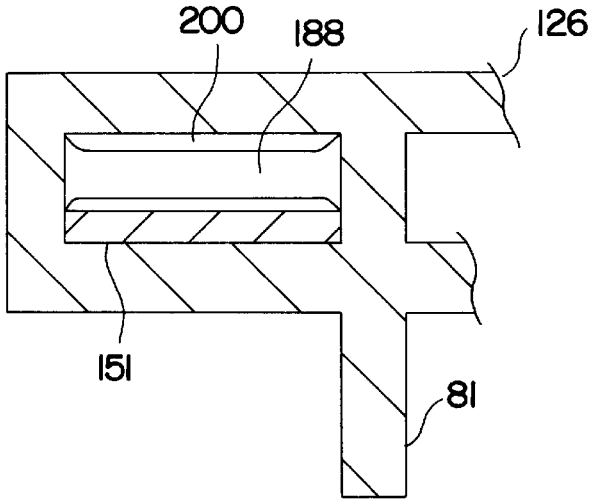
FIG. 5 is a cross sectional view taken on line CC of FIG. 2.

In FIG. 5, being an enlarged cross sectional view taken on line C—C of FIG. 2, the adjusting plate 151 is provided in the passage 188, whereby the flow passage cross sectional area is made narrower than the prior art case and the flow velocity of the air there is increased. Also, the turbulators 200 are provided to upper and lower wall surfaces of the passage 188, whereby the heat transfer effect by convection is increased. In the gas turbine stationary blade having the air cooled structure of the second stage stationary blade 17 as described above, the passage 91 of the cooling air which has been provided in the front flange 81 of the leading edge portion 41 in the prior art case is eliminated, and the entire amount of the cooling air in the passage 188 of the leading edge portion 41 is caused to flow through the passages 93, 94 provided in the rails 96, 97 of the side edge portions. In order to lead the entire amount of the cooling air which has flowed through the leading edge passage 42 for cooling of the blade portion 25 into the passage 188, the bottom plate 150 is provided so as to close the bottom portion of the leading edge passage 42. Further, in order to increase the flow velocity of the air in the passage 188 of the leading edge portion 41, the adjusting plate 151 is provided. Also, the turbulators 200 are provided for increasing the cooling effect. Thus, the following effects of the invention can be obtained.

The entire amount of the cooling air from the leading edge passage 42 flows into the passage 188 of the leading edge portion 41 and this air is used in its entire amount for cooling of the leading edge portion 41 without a portion thereof being taken for cooling of the central portion as has been done in the prior art case. Hence, the cooling effect of the leading edge portion 41, which is exposed to a high temperature gas and is in a severe temperature condition, is enhanced greatly as compared with the prior art.

The adjusting plate 151 is provided in the passage 188 of the leading edge portion 41 so that the flow passage cross sectional area is made narrower and the flow velocity is increased, as compared with the prior art case. Further, the turbulators 200 are provided in the passage 188, hence the cooling effect of the passage 188 is enhanced greatly as compared with the prior art case where only the needle-like fins are provided in the passage 88.

The entire amount of the cooling air which has entered the passage 188 of the leading edge portion 41 further flows separately into the passages 93, 94, respectively, of the rails 96, 97 of the side edge portions, so that the air amount flowing in the passages 93, 94 increases as compared with the prior art case. Hence the cooling effect of the side edge portions, which are exposed to the high temperature gas, increases. In the prior art case, the air which has entered the passage 88 portionally flows into the passage 91 of the front flange 81 for cooling of the central portion and portionally flows into the passages 93, 94. In the present invention, however, the passage 91 is eliminated, hence the amount of the cooling air flowing in the passages 93, 94 increases by that degree.

It is understood that the invention is not limited to the particular construction and arrangement herein illustrated and described but embraces such modified forms thereof as come within the scope of the following claims.

What is claimed is:

1. A gas turbine stationary blade, comprising:

an outer shroud for receiving air from a compressor;

a blade portion having a leading edge side passage and a trailing edge side passage for receiving the air from said outer shroud as cooling air for said blade portion;

an inner shroud having a leading edge portion, side edge portions, a central portion and a trailing edge portion, and forming a cavity arranged to receive the air from said trailing edge side passage, wherein said inner shroud and said cavity are arranged such that when air is received in said cavity the air is portionally led from said cavity into spaces formed between said stationary blade and front and rear moving blades adjacent thereto as seal air and portionally led from said cavity into said inner shroud so as to flow through said central portion to said trailing edge portion and then outside of said inner shroud;

a bottom plate closing said cavity off from said leading edge side passage; and a passage from said leading edge side passage to said leading edge portion which causes the entire amount of air from said leading side edge passage to flow into a passage of said leading edge portion of said inner shroud along said bottom plate;

wherein said inner shroud is arranged such that air from said passage of said leading edge portion flows therefrom through said side edge portions and then said trailing edge portion and is then discharged to the outside.

2. The gas turbine stationary blade of claim 1, wherein an adjusting plate is provided in said passage of said leading edge portion for setting the flow passage cross sectional area of said passage of said leading edge portion.

3. The gas turbine stationary blade of claim 1, wherein said passage of said leading edge portion comprises a plurality of turbulators.

4. A gas turbine stationary blade, comprising:

an outer shroud for receiving air from a compressor;

a blade portion having a leading edge side passage and a trailing edge side passage for receiving the air from said outer shroud as cooling air for said blade portion;

an inner shroud having a leading edge portion, side edge portions, a central portion and a trailing edge portion, and forming a cavity arranged to receive the air from said trailing edge side passage, wherein said inner shroud and said cavity are arranged such that when air is received in said cavity the air is portionally led from said cavity into spaces formed between said stationary blade and front and rear moving blades adjacent thereto as seal air and portionally led from said cavity into said inner shroud so as to flow through said central portion to said trailing edge portion and then outside of said inner shroud, and wherein said cavity is closed off from said leading edge side passage; and a passage from said leading edge side passage to said leading edge portion which causes the entire amount of air from said leading side edge passage to flow into said leading edge portion of said inner shroud;

wherein said inner shroud is arranged such that air from said leading edge portion flows therefrom through said side edge portions and then said trailing edge portion and is then discharged to the outside.

* * * * *